US007431575B2

(12) United States Patent
Hawkins et al.

(10) Patent No.: US 7,431,575 B2
(45) Date of Patent: Oct. 7, 2008

(54) AUTO VALVE PRIMING PUMP

(75) Inventors: Charles W. Hawkins, Sparta, TN (US); Ricky England, Sparta, TN (US); Kevin C. South, Cookeville, TN (US); Jeffrey B. Sharp, Cookeville, TN (US); Ismail C. Bagci, Cookeville, TN (US); Mark J. Johnson, Cookeville, TN (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 491 days.

(21) Appl. No.: 11/040,878

(22) Filed: Jan. 21, 2005

(65) Prior Publication Data

US 2006/0165540 A1 Jul. 27, 2006

(51) Int. Cl.
*F04B 23/00* (2006.01)
*F04B 9/14* (2006.01)
*F04B 19/22* (2006.01)

(52) U.S. Cl. ..... 417/440; 417/559

(58) Field of Classification Search ..... 417/199.2, 417/440, 559, 279; 222/153.12, 153.14
See application file for complete search history.

(56) References Cited

U.S. PATENT DOCUMENTS 1,108,903 A 9/1914 Hancock
1,366,180 A 1/1921 Herzmark
1,934,878 A * 11/1933 Parker ..... 137/565.12
2,001,126 A * 5/1935 Cummins ..... 123/450
2,012,721 A 8/1935 Johnson ..... 103/2
2,412,532 A 12/1946 Parker et al. ..... 103/2
2,450,295 A 9/1948 Parker et al. ..... 277/5
4,012,174 A 3/1977 Seibel et al. ..... 417/307
5,256,040 A * 10/1993 Davis et al. ..... 417/440
5,307,770 A 5/1994 Davis et al. ..... 123/179.11
5,643,446 A 7/1997 Clausen et al. ..... 210/184
5,664,532 A * 9/1997 August ..... 123/179.11

* cited by examiner

*Primary Examiner*—Devon Kramer
*Assistant Examiner*—Philip Stimpert
(74) *Attorney, Agent, or Firm*—Hamre, Schumann, Mueller & Larson, P.C.; J. Bruce Schelkopf

(57) ABSTRACT

A priming pump for fluid delivery arranged with a base defining a flow inlet, a flow outlet, and a control valve positioned therebetween. The priming pump includes a housing assembled to the base with an inlet flow valve positioned in an inlet valve compartment and an outlet flow valve positioned in an outlet valve compartment. The valve compartments are in communication with a plunger chamber including an axially movable plunger. A spring-biased control knob is assembled to the plunger and to the control valve for controlling its position between either a direct-flow orientation or a by-pass orientation. With the control valve in the by-pass orientation, upward movement of the control knob draws fluid into the inlet valve compartment and into the plunger chamber. The down stroke of the control knob pushes the fluid out of the plunger chamber.

27 Claims, 5 Drawing Sheets

AUTO VALVE PRIMING PUMP

BACKGROUND OF THE INVENTION

The present invention relates in general to priming pumps for use with a fuel delivery system. The priming pump cooperates with a base structure having a fuel inlet, a fuel outlet, and a fuel flow valve positioned partially in the base and cooperating with components of the priming pump to determine whether fuel flows through the priming pump or by-passes the priming pump.

More specifically, the present invention relates to the use of a spring-biased control knob for a priming pump, the control knob being positionable in either a locked position or a priming position. When the control knob is in the locked position, the fuel flow valve is opened and the fuel flow by-passes the priming pump and travels directly to a downstream, remote location. In this open condition, the priming pump of the present invention adds little, if any, flow restriction or what would be considered a minimum flow restriction. When priming is required or desired, the described control knob is rotated to an unlocked position and moves under a spring-biasing force to an up position. With the control knob in this position, the fuel flow valve is closed and any straight fuel flow through the base from the fuel inlet to the fuel outlet is blocked and the incoming fuel flow is redirected through the priming pump. A downward stroke of the control knob pushes the fuel within the priming pump out through the outlet opening of the base.

Current priming pumps that are used in fuel systems, excluding the present invention, are generally considered to be restrictive relative to the flow that is permitted or blocked and typically require additional systems and structures for the requisite fuel routing. Obviously, these additional requirements add both size and cost to the overall system. With the rapid development of modular fuel systems, greater attention has been directed to the need for a less restrictive, more easily operated, fuel priming pump. The priming pump of the present invention addresses these considerations in a novel and unobvious manner.

SUMMARY OF THE INVENTION

A priming pump for a fluid system according to one embodiment of the present invention cooperates with a base component defining a flow inlet, a flow outlet, and including a flow control valve positioned between the flow inlet and flow outlet. The priming pump comprises a housing located atop the base with an inlet valve compartment, an outlet valve compartment, and a plunger chamber that is in flow communication with the inlet and outlet valve compartments. Flow into and out of the priming pump housing is controlled in part by an inlet flow valve positioned in the inlet valve compartment and in part by an outlet flow valve positioned in the outlet valve compartment. The priming pump includes a control knob assembled to a plunger that is positioned in the housing and is configured to encircle the plunger chamber. The control knob is axially movable toward the base and is connected to the flow control valve such that the flow control valve is positionable by the control knob in either a direct-flow orientation or alternatively in a by-pass orientation. When the flow control valve is in the direct-flow orientation, flow from the flow inlet is routed directly through the flow control valve to the flow outlet. When the flow control valve is in the by-pass orientation, fluid is drawn into the plunger chamber by way of the inlet flow valve as the control knob moves upwardly. Fluid is pushed out of the plunger chamber through the outlet flow valve as the control knob moves downwardly.

One object of the present invention is to provide an improved priming pump for a fluid system.

Related objects and advantages of the present invention will be apparent from the following description.

DESCRIPTION OF THE PREFERRED EMBODIMENT

Figure 1:
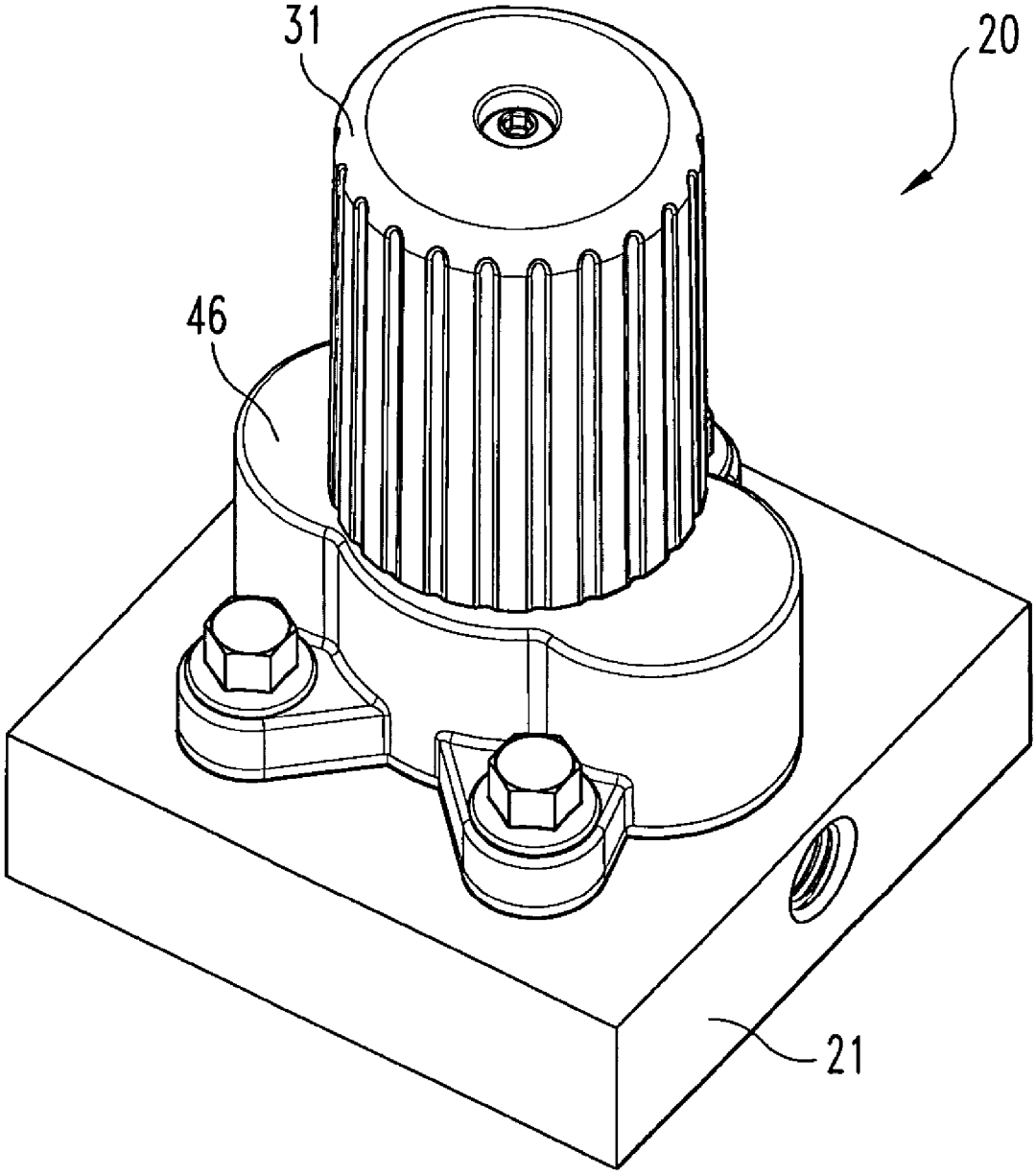
FIG. 1 is a perspective view of a priming pump and base according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
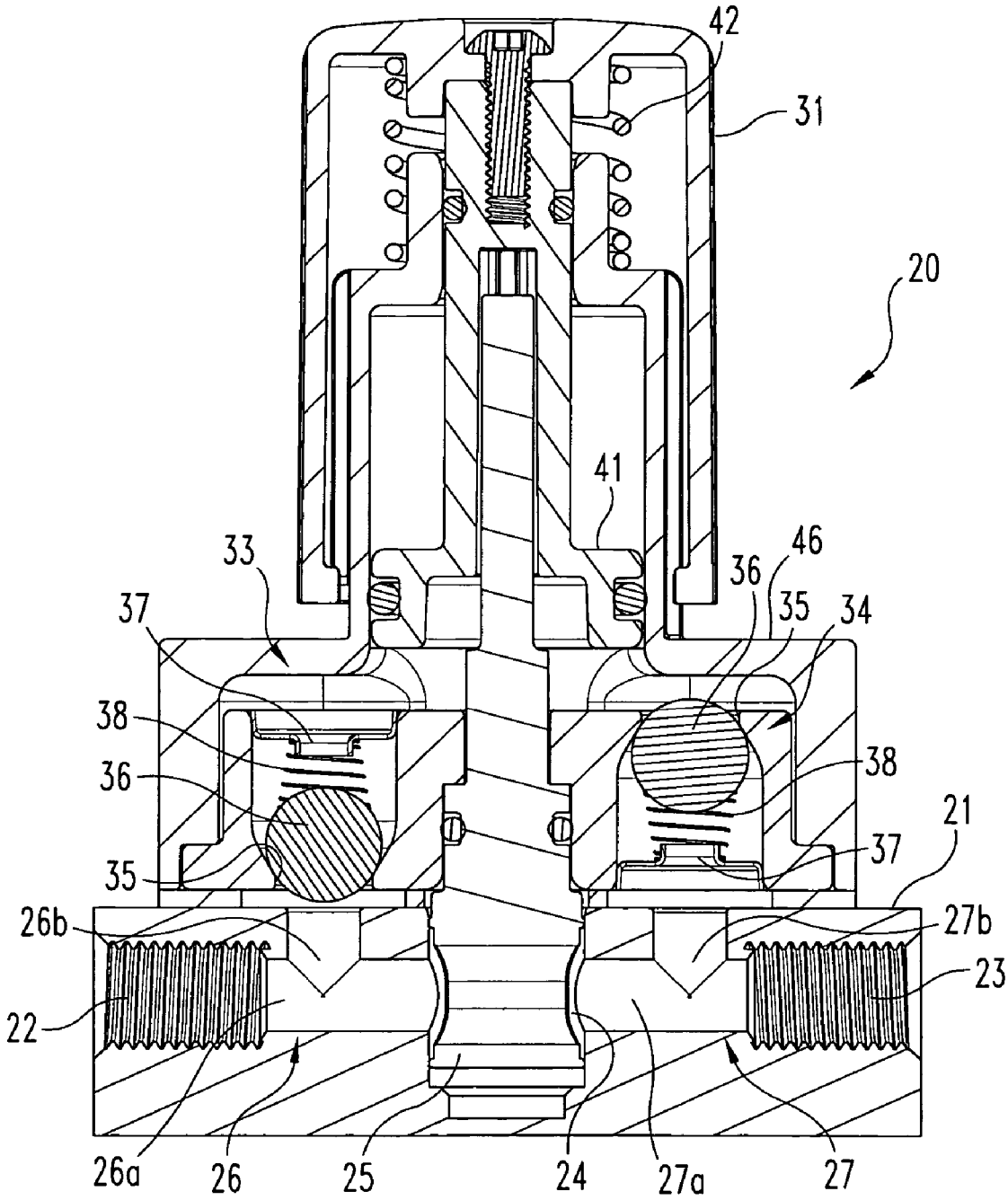
FIG. 2 is a front elevational view, in full section, of the FIG. 1 priming pump and base, illustrating a direct-flow orientation, according to the present invention.
Figure 3:
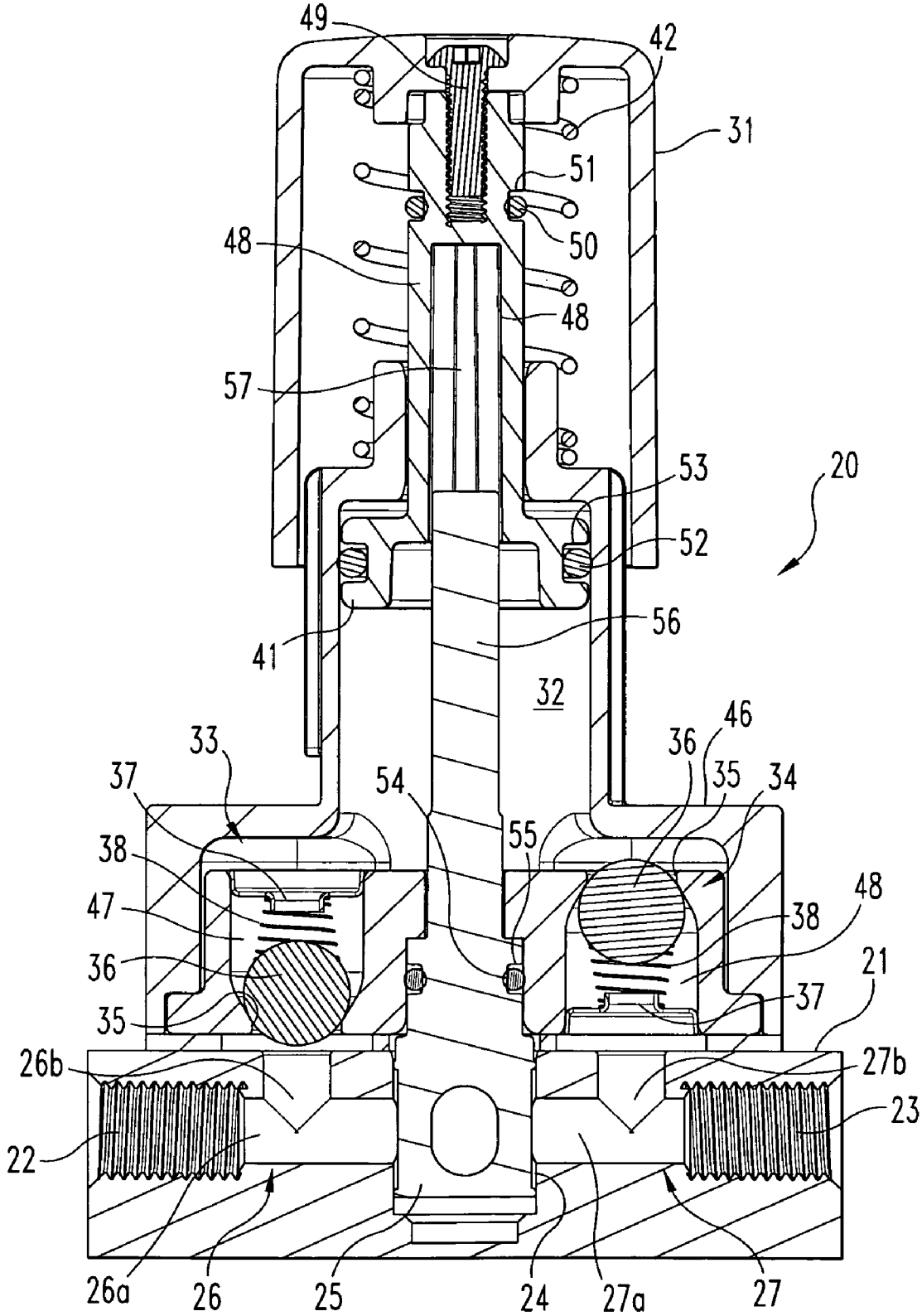
FIG. 3 is a front elevational view, in full section, of the FIG. 1 priming pump and base illustrating a by-pass orientation, according to the present invention.

Referring to FIGS. 1, 2 and 3, there is illustrated a priming pump 20 that is constructed and arranged according to the present invention. Priming pump 20 is structurally configured for use with an in-line fuel delivery system. As such, the priming pump is mounted to a base 21 that is intended to represent a portion of the vehicle engine or a portion of the overall fuel delivery system. Whatever structure would typically provide the flow in and flow out passageways and openings is intended to be represented by base 21. As illustrated, the base 21 structure that supports priming pump 20 and cooperates with the overall operation of priming pump 20, defines a fuel inlet 22 and a fuel outlet 23. Fuel inlet 22 is upstream from priming pump 20 while the fuel outlet 23 is downstream from priming pump 20. Formed within base 21 is a flow valve cavity 24 (see FIGS. 2 and 3) that houses at least a portion of flow-control valve 25. As will be clear from the drawings provided, a portion of the flow-control valve 25 extends up into priming pump 20 and the positioning of flow-control valve 25 is controlled by selected component parts of priming pump 20.

A fuel-in passageway 26 is defined by base 21 and connects the fuel inlet 22 with the interior of priming pump 20. A fuel-out passageway 27 is defined by base 21 and connects the fuel outlet 23 with the interior of priming pump 20. As is illustrated in FIGS. 2 and 3, passageway 26 includes a first portion **26*a* connecting the fuel inlet 22 with cavity 24 and a second portion 26*b* connecting the first portion 26*a* with the interior of priming pump 20. Passageway 27 includes a first portion 27***a* connection the fuel outlet 23 with cavity 24 and a second portion 27*b* connecting the first portion 27*a* with the interior of priming pump 20.

The flow-control valve 25 is constructed and arranged so as to permit fuel flow from the fuel inlet 22 directly to the fuel outlet 23 without introducing any flow restrictions when the priming pump 20 is in the closed and locked position of FIG. 2. When the priming pump 20 is to be used, it is unlocked by the rotation of the control knob 31. When control knob 31 is rotated, its connection to the flow control valve 25 causes the valve to close off or block any fuel flow from fuel inlet 22 directly through to fuel outlet 23, as is illustrated in FIG. 3. It should be understood that the control knob 31, when in its down position, is constructed and arranged so as to lock itself in that position relative to the housing of priming pump 20. All that is required to unlock the control knob 31 is to rotate the control knob and this rotation automatically changes the condition of flow-control valve 25 from a direct-flow orientation into a by-pass orientation wherein the priming pump 20 is opened and ready to be used.

As is illustrated, control knob 31 is spring-biased such that unlocking the control knob from the priming pump housing results in the upward axial movement of control knob 31 in an automatic fashion and this movement in the upward direction corresponds to a first step or portion of the overall fuel pumping action. As the control knob 31 moves in an upward direction due to the action of spring 42, an interior plunger 41 moves in that same direction, creating a low pressure area and thus suction so as to draw fuel in to chamber 32 of priming pump 20 by way of passageway portion 26*b* and ball valve 33. On the down stroke of control knob 31, fuel within chamber 32 is pushed out of the priming pump by way of ball valve 34 and passageway portion 27*b*. As would be understood, the fuel enters by way of inlet 22 and travels through portion 26*a* before flowing into chamber 32. Similarly, from portion 27*b*, the exiting fuel travels through portion 27*a* to fuel outlet 23.

Ball valves 33 and 34 are each constructed with a valve seat 35, ball 36, flow outlet 37, and biasing spring 38. The inverted orientation of the two ball valves means generally that as one valve opens, the other valve closes and vice versa. In use, when priming is desired, the control knob is released from its locked condition and, as it is turned, it positions the flow-control valve 25 in a closed or blocking orientation, as illustrated in FIG. 3. Rotation of the control knob causes corresponding rotation of the plunger 41 due to a direct, threaded-fastener connection. The post of the plunger is internally shaped for a male-female fit with the upper post of the flow control valve. This keyed, male-female interfit causes rotation of valve 25 as the control knob turns. As would be understood from the drawing figures, placing the flow-control valve 25 in this closed or blocking orientation results in blocking any direct (in-line) flow of fuel from inlet 22 directly through to outlet 23 by way of the flow valve cavity 24. As described, when the control knob 31 is released from its locked condition, biasing spring 42 acts between the interior of the control knob and an upper surface of the housing 46, causing the control knob to move in an axially upward direction, automatically. The plunger 41 creates a low pressure zone in chamber 32 and this pulls up on the ball 36 of valve 33 and on the ball 36 of valve 34. Movement of ball 36 in valve 33 acts against the biasing spring 38 as the ball 36 lifts up off of its valve seat 35. This enables fuel flow into chamber 32. At the same time, ball 36 in valve 34 remains seated against seat 35 so as to prevent any noticeable fuel flow in either direction through or across ball valve 34 and the added suction force establishes a tight seal with ball 36 against its corresponding seat.

After a quantity of fuel is drawn into chamber 32, the next step in the priming process is to initiate the downward stroke by pushing knob 31 axially in the direction of base 21. This action causes plunger 41 to push the quantity of fuel out of chamber 32 against both the ball 36 in valve 33 and against ball 36 in valve 34. After the initial suction is created within chamber 32 by the upward movement of the control knob, ball 36 in valve 33 returns to its seated position against valve seat 35. Once fuel enters to offset the pressure differential within chamber 32, the biasing spring 38 has sufficient force to overcome any offsetting pressure and returns the ball 36 to valve seat 35. As such, with the downward stroke of control knob 31, there is no flow path through or across ball valve 33. However, on the opposite side, spring-biased ball 36 in valve 34 is able to be moved by the pressure force exerted by the fuel and the downward stroke of control knob 31. Since this downward force is greater than the offsetting force from biasing spring 38, ball valve 34 opens. This allows the fuel within chamber 32 to flow to the fuel outlet 23, as previously described. While a small portion of the quantity of fuel in chamber 32 may be retained in the small space above ball 36 in valve 33, the majority of that quantity of fuel in chamber 32 is pushed out of priming pump 20 through the fuel outlet 23 in base 21.

At the end of the downward stroke, spring 42 automatically returns knob 31 to its upward position. This action draws in another quantity of fuel into chamber 32 by way of ball valve 33, thus repeating the cyclic process in an automatic or near-automatic fashion. The only manual interaction is to push the control knob in a downward direction and to decide at what point the control knob would be placed in its locked position or released from its locked position. As this quantity of fuel is being drawn in for the second cycle, the biasing spring 38 in ball valve 34 returns the ball 36 to a closed position against seat 35 and the priming pump 20 is then ready for the delivery of another quantity of fuel from within chamber 32 out through fuel outlet 23. At the end of any downward stroke of control knob 31, if no further fuel is to be pumped for the purposes of priming, the control knob is simply turned so as to lock the control knob in a downward position at which time valve 25 is returned to an open position (see FIG. 2), allowing a direct through path from fuel inlet 22 to fuel outlet 23.

The construction of priming pump 20, excluding base 21, includes the referenced housing 46 that is located atop base 21 and defines the plunger chamber 32, an inlet valve compartment 47 for housing ball valve 33, and an outlet valve compartment 48 for housing ball valve 34. As would be understood, compartments 47 and 48 separately communicate with chamber 32, but are otherwise isolated from each other. Housing 46 is attached to base 21 in a secure and leak-free manner. Plunger 41 is positioned inside chamber 32 and the plunger shaft 48 extends out of the housing.

As would be understood from the FIG. 2 and FIG. 3 illustrations, the control knob 31 is connected to the upper portion of plunger shaft 48 by a threaded fastener 49. The interior of plunger shaft 48 is constructed and arranged to receive post 56 of flow control valve 25 with a "keyed" interfit so that rotation of the control knob 31 translates into rotation of the plunger 41 and rotation of the plunger translates into rotation of the flow control valve 25. The keying is preferably by forming a female form on the post 56 and a cooperating male form on the inside surface of shaft 48, such as axial rib 57. A first O-ring seal 50 is positioned within channel 51 as part of plunger shaft 48. A further O-ring seal 52 is positioned within a cooperating channel 53 as part of the body of plunger 41. The lower portion of the flow-control valve 25 includes an O-ring seal 54 positioned in groove 55.

Figure 4:
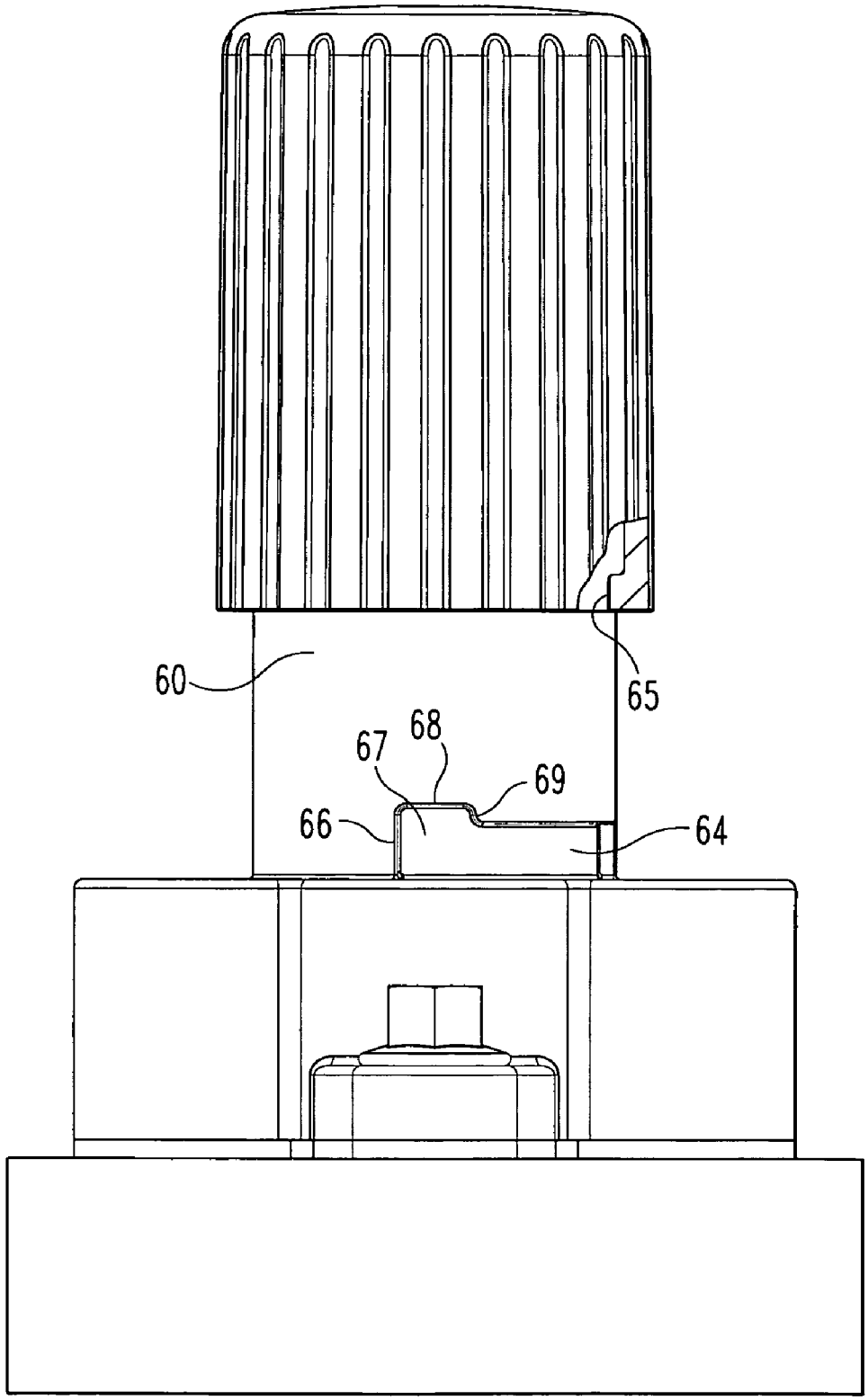
FIG. 4 is a side elevational view of the FIG. 1 priming pump and base illustrating a locking feature, according to the present invention.
Figure 5:
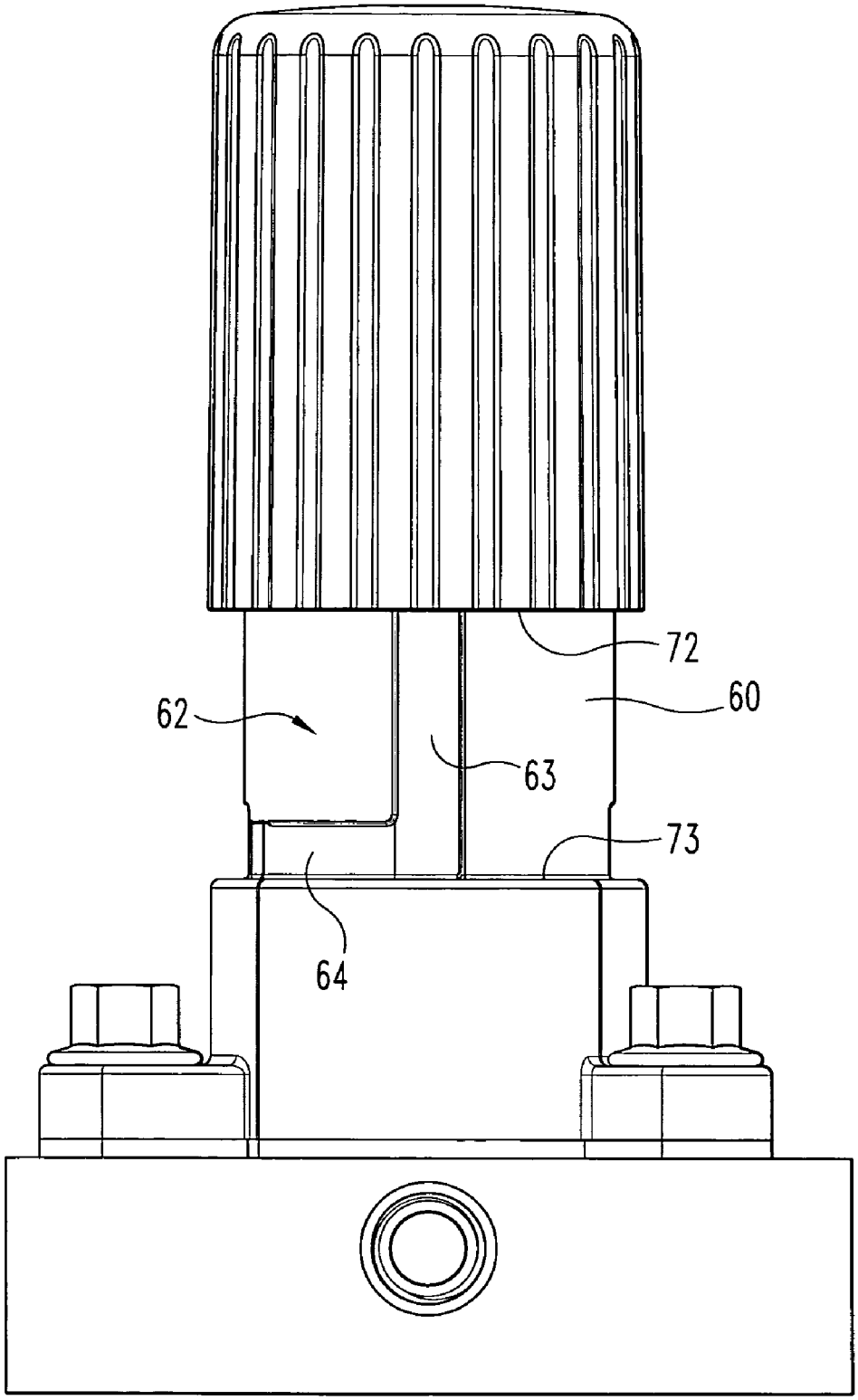
FIG. 5 is a front elevational view of the FIG. 1 priming pump and base illustrating another portion of the locking feature, according to the present invention.

While the locking of control knob 31 in the down position is able to be accomplished in less efficient ways, the preferred design, according to the present invention, is illustrated in greater detail in FIGS. 4 and 5. The upper portion 60 of housing 46 is a generally cylindrical portion that is sized closely to the size of the inside diameter surface of control knob 31. In this way, the axial movement of the control knob 31 is smooth and precise, whether moving up due to the spring force or moving down by manual action.

Upper portion 60 is configured with an L-shaped channel 62 including an axial or vertical section 63 and a connected circumferential or horizontal section 64. The control knob 31 includes a radially inwardly extending rib 65 that is received by and travels in channel 62. The circumferential extent of section 64 is approximate 90 degrees. The closed end 66 includes an axially raised space 67 (see FIG. 4). Space 67 is important in order to keep the control knob 31 from rotating due to vibration or inadvertent handling that is not intended to actually release control knob 31 from its locked condition. The spring-biased nature of control knob 31 causes the control knob to try and move upwardly. The closed end 68 of space 67 provides an abutment for rib 65 against any unintended axial movement of control knob 31. The axial wall 69 provides an abutment for rib 65 against the unintended counterclockwise rotation of control knob 31.

When control knob 31 is to be locked in its down position, it is pushed down toward base 21 until lower edge 72 is adjacent upper surface 73. During this axial movement of control knob 31, rib 65 travels in channel 62 with a close clearance fit. When the control knob 31 is pushed to its lowest point of travel, rib 65 is aligned with section 64 and this enables the control knob to be rotated in a clockwise direction approximately 90 degrees. This locks the control knob in the down position. In order to release control knob 31 from its locked position, it must first be pushed downward very slightly so as to move rib 65 out of space 67 and then rotate the control knob in a counterclockwise direction until rib 65, as traveling through section 64, reaches section 63. At this point, since axial travel would now be permitted, the biasing spring takes over and, through that spring force, pushes upwardly on the control knob 31 in an automatic fashion.

The ninety degrees of rotation for control knob 31 is important so that the flow control valve 25 will be positioned in the by-pass orientation (see FIG. 3) when the rib 65 is circumferentially aligned with section 64. Then, when the control knob 31 is turned ninety degrees in a clockwise direction, the rib 65 abuts against closed end 66 while, at the same time, the control knob turns the flow control valve 25 ninety degrees so as to position that valve 25 in the direct-flow orientation (see FIG. 2).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A priming pump for a fluid system that is constructed and arranged to connect to a base having a flow inlet, a flow outlet, and a flow control valve positioned between said flow inlet and said flow outlet, said priming pump comprising:

a housing located atop said base and having an inlet valve compartment downstream from an inlet flow valve, an outlet valve compartment downstream from an outlet flow valve, and a plunger chamber in flow communication with said inlet and outlet valve compartments, the plunger chamber disposed between the inlet and outlet valve compartments and separating the inlet and outlet valve compartments into isolated compartments that communicate separately with the plunger chamber; and a control knob assembled to a plunger positioned in said housing and configured to encircle said plunger chamber, said control knob being axially movable toward said base, said control knob being connected to said flow control valve, wherein said flow control valve is positionable by said control knob into a direct-flow orientation and alternatively is positionable in a by-pass orientation, when in said direct-flow orientation flow from said flow inlet is routed through said flow control valve to said flow outlet, and when in said by-pass orientation fluid is drawn into said plunger chamber by way of said inlet flow valve as said control knob moves upwardly and fluid is pushed out of said plunger chamber through said outlet flow valve as said control knob moves downwardly.

2. The priming pump of claim 1 wherein said inlet flow valve is a ball valve and said outlet flow valve is a ball valve.

3. The priming pump of claim 2 wherein said control knob is lockable into a locked position with respect to said housing when said control knob is in a down position.

4. The priming pump of claim 3 wherein said control knob is spring-biased so as to position said control knob in an up position when the control knob is not locked to said housing in said down position.

5. The priming pump of claim 4 wherein said control knob and said housing are constructed and arranged for said control knob to lock itself to said housing by rotating said control knob relative to said housing.

6. The priming pump of claim 5 wherein said locked position of said control knob corresponds to said direct-flow orientation.

7. The priming pump of claim 1 wherein said control knob is lockable into a locked position with respect to said housing when said control knob is in a down position.

8. The priming pump of claim 7 wherein said control knob is spring-biased so as to position said control knob in an up position when the control knob is not locked to said housing in said down position.

9. The priming pump of claim 8 wherein said control knob and said housing are constructed and arranged for said control knob to lock itself to said housing by rotating said control knob relative to said housing.

10. The priming pump of claim 9 wherein said locked position of said control knob corresponds to said direct-flow orientation.

11. A fluid delivery system for routing fluid from a source to a remote location, said fluid delivery system including a direct-flow mode and a by-pass mode for priming, said fluid delivery system comprising:

a base defining a flow inlet, a flow outlet, and a flow control valve positioned between said flow inlet and said flow outlet; and a priming pump connected to said base, said priming pump including:

a housing located atop said base and having an inlet valve compartment downstream from an inlet flow valve, an outlet valve compartment downstream from an outlet flow valve, and a plunger chamber in flow communication with said inlet and outlet valve compartments, the plunger chamber disposed between the inlet and outlet valve compartments and separating the inlet and outlet valve compartments into isolated compartments that communicate separately with the plunger chamber; and a control knob assembled to a plunger positioned in said housing and configured to encircle said plunger chamber, said control knob being axially movable toward said base, said control knob being connected to said flow control valve, wherein said flow control valve is positionable by said control knob into a direct-flow orientation and alternatively is positionable in a by-pass orientation, when in said direct-flow orientation flow from said flow inlet is routed through said flow control valve to said flow outlet, and when in said by-pass orientation fluid is drawn into said plunger chamber by way of said inlet flow valve as said control knob moves upwardly and fluid is pushed out of said plunger chamber through said outlet flow valve as said control knob moves downwardly.

12. The fluid delivery system of claim 11 wherein said inlet flow valve is a ball valve and said outlet flow valve is a ball valve.

13. The fluid delivery system of claim 12 wherein said control knob is lockable into a locked position with respect to said housing when said control knob is in a down position.

14. The fluid delivery system of claim 13 wherein said control knob is spring biased so as to position said control knob in an up position when the control knob is not locked to said housing in said down position.

15. The fluid delivery system of claim 14 wherein said control knob and said housing are constructed and arranged for said control knob to lock itself to said housing by rotating said control knob relative to said housing.

16. The fluid delivery system of claim 15 wherein said locked position of said control knob corresponds to said direct-flow orientation.

17. The fluid delivery system of claim 11 wherein said control knob is lockable into a locked position with respect to said housing when said control knob is in a down position.

18. The fluid delivery system of claim 17 wherein said control knob is spring-biased so as to position said control knob in an up position when the control knob is not locked to said housing in said down position.

19. The fluid delivery system of claim 18 wherein said control knob and said housing are constructed and arranged for said control knob to lock itself to said housing by rotating said control knob relative to said housing.

20. The fluid delivery system of claim 19 wherein said locked position of said control knob corresponds to said direct-flow orientation.

21. A method of operating a fuel delivery system priming pump that is connected to a base, said base defining a flow inlet, a flow outlet, and a flow control valve positioned between said flow inlet and said flow outlet, said priming pump including a housing having an inlet valve compartment downstream from an inlet flow valve, an outlet valve compartment downstream from an outlet flow valve, and a plunger chamber in flow communication with said inlet and outlet valve compartments, the plunger chamber disposed between the inlet and the outlet valve compartments and separating the inlet and outlet valve compartments into isolated compartments that communicate separately with the plunger chamber, and an axially movable, spring-biased control knob assembled to a plunger positioned in said housing and connected to said flow control valve, said flow control valve is positionable by said control knob into a direct-flow orientation and alternatively into a by-pass orientation, when in said direct-flow orientation, flow from said flow inlet is routed through said flow control valve to said flow outlet and when in said by-pass orientation, flow is drawn into said plunger chamber by way of said inlet flow valve as said control knob moves upwardly and fluid is pushed out of said plunger chamber through said outlet flow valve as said control knob moves downwardly, said method comprising the following steps:

(a) rotating said control knob relative to said housing so as to unlock the control knob from said housing, said knob moving to an up position once unlocked;

(b) drawing fluid into said plunger chamber by way of said inlet flow valve as said control knob moves to said up position;

(c) pushing said control knob to a down position so as to push fluid out of said plunger chamber and through said outlet flow valve; and (d) when said control knob is in said down position, rotating said control knob for locking said control knob in said down position relative to said housing.

22. The method of claim 21 which further includes repeating steps (b) and (c) prior to step (d).

23. The method of claim 21 wherein said unlocking rotating step changes the orientation of said flow control valve from said direct-flow orientation to said by-pass orientation.

24. The method of claim 23 wherein said locking rotating step changes the orientation of said flow control valve from said by-pass orientation to said direct-flow orientation.

25. A fluid delivery system for routing fluid from a source to a remote location, said fluid delivery system including a direct-flow mode and a by-pass mode for priming, said fluid delivery system comprising:

a base defining a flow inlet, a flow outlet, and a flow control valve positioned between said flow inlet and said flow outlet; and a priming pump connected to said base, said priming pump including:

a housing located atop said base and having an inlet valve compartment downstream from an inlet flow valve, an outlet valve compartment downstream from an outlet flow valve, and a plunger chamber in flow communication with said inlet and outlet valve compartments, the plunger chamber disposed between the inlet and outlet valve compartments and separating the inlet and outlet valve compartments into isolated compartments that communicate separately with the plunger chamber; and a control knob assembled to a plunger positioned in said housing and configured to encircle said plunger chamber, said control knob being axially movable toward said base, said control knob being connected to said flow control valve, wherein said flow control valve is positionable by said control knob into a direct-flow orientation and alternatively is positionable in a by-pass orientation, when in said direct-flow orientation flow from said flow inlet is routed through said flow control valve to said flow outlet, and when in said by-pass orientation fluid is drawn into said plunger chamber by way of said inlet flow valve as said control knob moves upwardly and fluid is pushed out of said plunger chamber through said outlet flow valve as said control knob moves downwardly, the control knob is lockable into a locked position with respect to said housing when said control knob is moved toward said base, the control knob including a lock member disposed on the control knob, the lock member communicating with a space disposed on an external surface of the housing so as to lock and unlock the control knob.

26. The fluid delivery system according to claim 25, wherein the lock member comprises a radially inwardly extending rib that is received by the space so as to lock and unlock the control knob, the space comprising a channel and closed end, the channel configured to allow the radially inwardly extending rib to move therein to lock and unlock the control knob, the closed end configured to maintain the control knob in the locked position.

27. A fluid delivery system for routing fluid from a source to a remote location, said fluid delivery system including a direct-flow mode and a by-pass mode for priming, said fluid delivery system comprising:

a base defining a flow inlet, a flow outlet, and a flow control valve positioned between said flow inlet and said flow outlet; and a priming pump connected to said base, said priming pump including:

a housing located atop said base and having an inlet valve compartment downstream from an inlet flow valve an outlet valve compartment downstream from an outlet flow valve, and a plunger chamber in flow communication with said inlet and outlet valve compartments, the plunger chamber disposed between the inlet and outlet valve compartments and separating the inlet and outlet valve compartments into isolated compartments that communicate separately with the plunger chamber;

the inlet flow valve disposed upstream from the flow control valve and communicating with the flow inlet of the base;

the outlet flow valve disposed downstream from the flow control valve and communicating with the flow outlet of the base; and a control knob assembled to a plunger positioned in said housing and configured to encircle said plunger chamber, said control knob being axially movable toward said base, said control knob being connected to said flow control valve, wherein said flow control valve is positionable by said control knob into a direct-flow orientation and alternatively is positionable in a by-pass orientation, when in said direct-flow orientation flow from said flow inlet is routed through said flow control valve to said flow outlet, and when in said by-pass orientation fluid is drawn into said plunger chamber by way of said inlet flow valve as said control knob moves upwardly and fluid is pushed out of said plunger chamber through said outlet flow valve as said control knob moves downwardly.

* * * * *